US006226965B1

(12) United States Patent
Lam

(10) Patent No.: US 6,226,965 B1
(45) Date of Patent: May 8, 2001

(54) INLINE CASE SEALING SYSTEM

(75) Inventor: Joe A. S. Lam, Richmond (CA)

(73) Assignee: Belcor Industries Inc, Richmond (CA)

( * ) Notice: Subject to any disclaimer, the term of this patent is extended or adjusted under 35 U.S.C. 154(b) by 0 days.

(21) Appl. No.: 09/457,002

(22) Filed: Dec. 8, 1999

(51) Int. Cl.[7] ..... B65B 7/20

(52) U.S. Cl. ..... 53/491; 53/377.4; 53/383.1; 493/128; 493/147; 493/183; 493/333

(58) Field of Search ..... 53/377.4, 376.5, 53/383.1, 491; 493/128, 129, 130, 131, 132, 147, 156, 183, 333

(56) References Cited

U.S. PATENT DOCUMENTS 3,716,962 * 2/1973 Langen et al. ..... 53/209
4,010,597 * 3/1977 Nelson ..... 53/374
4,109,444 * 8/1978 Lee ..... 53/186
4,213,285 * 7/1980 Mancini ..... 53/137
4,422,282 * 12/1983 Marchetti ..... 53/374
4,545,175 * 10/1985 Beckett ..... 53/69
5,063,726 * 11/1991 Boisseau ..... 53/491
5,106,359 * 4/1992 Lott ..... 493/125
5,393,291 * 2/1995 Wingerter ..... 493/116
5,440,852 8/1995 Lam ..... 53/377.2
5,511,362 * 4/1996 Morita et al. ..... 53/491
5,520,602 * 5/1996 Jenkins ..... 493/128
5,531,852 * 7/1996 Walsh et al. ..... 53/484

* cited by examiner

*Primary Examiner*—Stephen F. Gerrity
*Assistant Examiner*—Hemant M. Desai
(74) *Attorney, Agent, or Firm*—C. A. Rowley

(57) ABSTRACT

A case sealer for overlap flap type boxes wherein the major flaps extend greater than ½ the width of the carton. The case sealer uses a folding shoe for folding the inner major flap and then holding the inner major flap and a trailing minor flap in folded position until a plough folds a leading minor flap and the overlies the inner major flap and at least the leading minor flap at least until the outer major flap traps the trailing and leading flaps and thus the inner major flap in folded position.

20 Claims, 7 Drawing Sheets

INLINE CASE SEALING SYSTEM

FIELD OF THE INVENTION

The present invention relates to a method and apparatus for sealing cartons, particularly overlap flap type cartons, more specifically the present invention relates to an inline sealing system wherein the carton being sealed is moved in substantially a straight line for application of adhesive and the flap folding operations in a overlap flap box closure system

BACKGROUND OF THE INVENTION

In the closing of overlap flap boxes (i.e. cartons wherein at least one and generally both the major flaps each have an area and shape essentially more than half the width of the carton) it is the practice to direct the carton in a first direction and apply adhesive and particular closing steps to the carton flaps and then move the carton in a direction at 90° to the first direction to complete the adhesive and closing operations. Generally these machines are relatively expensive and operate relatively slowly. Mechanical or flap interference in folding and holding-down flaps is a major problem in the closing of overlap flap cartons.

Inline flap closing systems for handling and closing ordinary flap type boxes (as opposed to overlap flap boxes or cartons) are known (see for Example U.S. Pat. No. 5,440,852 issued Aug. 15, 1995 to Lam). In this particular system the leading flap (leading in the direction of movement of the carton through the machine) is first folded, then the trailing flap is folded followed by simultaneous folding of the two flaps with their longitudinal axes parallel to the direction of flow through the machine. In the arrangement the leading and trailing flaps are minor flaps and the other two flaps are the major flaps. This system does not lend itself without substantial modification to closing of overlap flap cartons or boxes.

BRIEF DESCRIPTION OF THE PRESENT INVENTION

It is the main object of the present invention to provide a simplified system for closing overlap flap type boxes or cartons.

It is an object of the present invention to provide a method and apparatus to fold four (4) flaps for closing one end of the box ore carton in a particular sequence so as to have both flap folding and flap holding occur without interference.

It is an object of the present invention to provide a method and apparatus for inline movement (i.e. movement along a straight line) during adhesive application and flap folding to close an overlap flap box or carton.

Broadly the present invention relates to a method and apparatus for closing a carton having mutually perpendicular side and end walls and an inner major overlap flap and an opposed outer major overlap flap each having dimensions more than half the width of said carton and each foldably connected along one side via a longitudinal fold line to it adjacent of said side walls and a pair of opposed minor flaps each foldably connected along one side via a transverse fold line to its adjacent of said end walls, each said minor flap having a length corresponding to a that of said end wall of said carton to which it is connected and a width extending from said transverse fold line to a free edge of said minor flap significantly shorter than length of said fold line comprising positioning said carton with said major and minor flaps in planes substantially parallel to said end or side wall to which it is connected, moving said carton with said flaps so positioned along a path in a direction parallel to said planes in which said major flaps are positioned, retaining said major flaps in their respective said plane, applying adhesive to an inner surface of said outer major flap and to an outer surface of said inner major flap while said flaps are so retained, folding said inner major flap into a position substantially perpendicular to said side wall to which it is connected without disrupting said adhesive applied to said inner major flap, folding the one of said minor flaps trailing in said direction of movement into a position overlying said inner major flap as said carton is moved long said path, holding said inner major flap and said trailing minor flap in folded position and folding another of said minor flaps leading in said direction of movement over said inner major flap as said carton is moved along said path, holding said trailing and said leading minor flaps and said inner major flap in folded position and folding said outer major flap into overlying relation with said minor flaps and said inner major flap and pressing said outer major flap onto said minor and said inner major flap.

Preferably said without disrupting said adhesive applied to said inner major flap comprises applying said adhesive to said inner flap in a pattern leaving a longitudinal portion of said inner major flap extending parallel to and adjacent to said fold line connecting said inner major panel to it adjacent side wall and along the full length of said inner major flap substantially free of adhesive to provide an adhesive area free area on said outer surface of said inner major flap wherein a folding element used to apply pressure to said inner major flap for said folding of said inner major flap into said position substantially perpendicular to said side wall may contact said outer surface of said inner major flap.

Preferably said longitudinal portion extends over at least 40% of said outer surface.

Preferably said pattern also leaves a central portion between adhesive applied areas extending said adhesive free area from said longitudinal portion between said adhesive applied areas toward a free edge of said inner major flap remote from said fold line connecting said inner major flap to its said side wall.

Preferably said pressing of said outer flap occurs in a pressing station when said carton is stationary.

BRIEF DESCRIPTION OF THE SEVERAL VIEWS OF THE DRAWING(S)

Further features, objects and advantages will be evident from the following detailed description of the preferred embodiments of the present invention taken in conjunction with the accompanying drawings in which.

Figure 4:
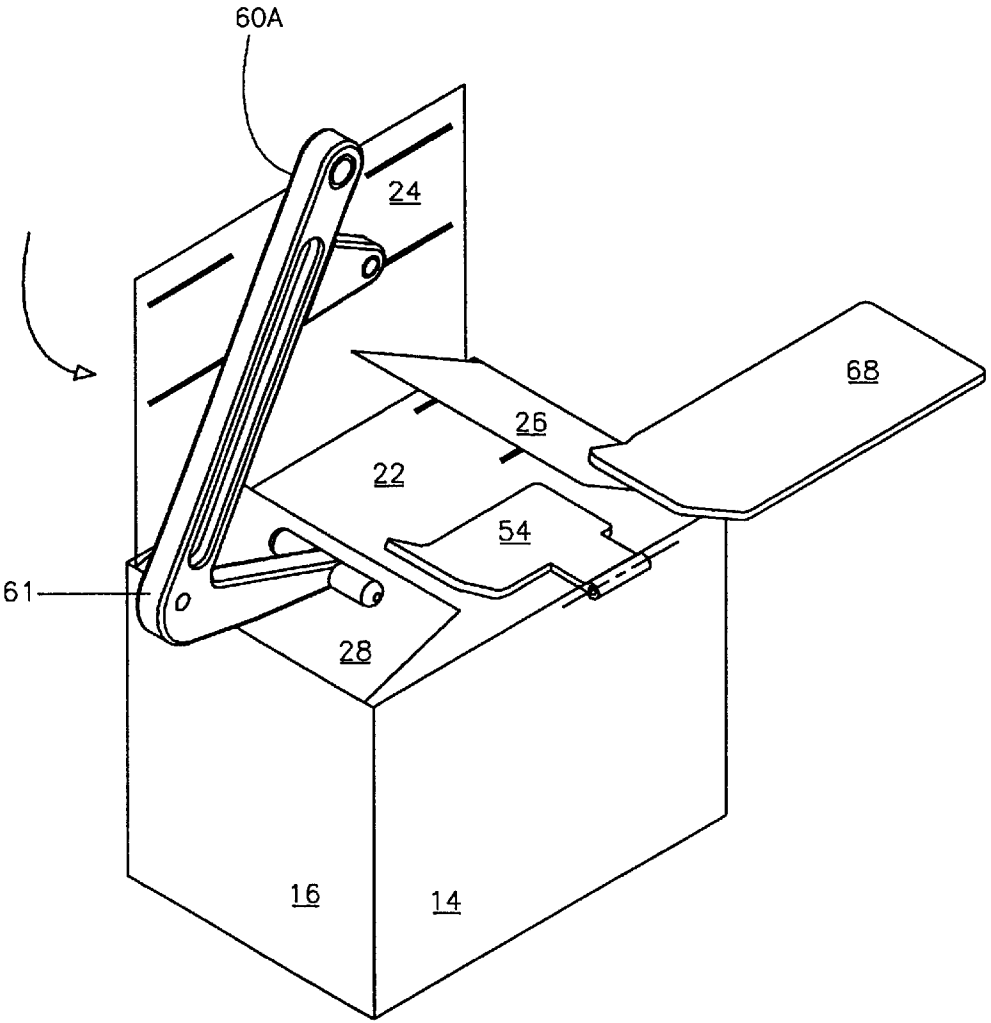

FIG. 4 schematically shows an alternative arrangement for closing the trailing minor flap of the carton.

Figure 5:
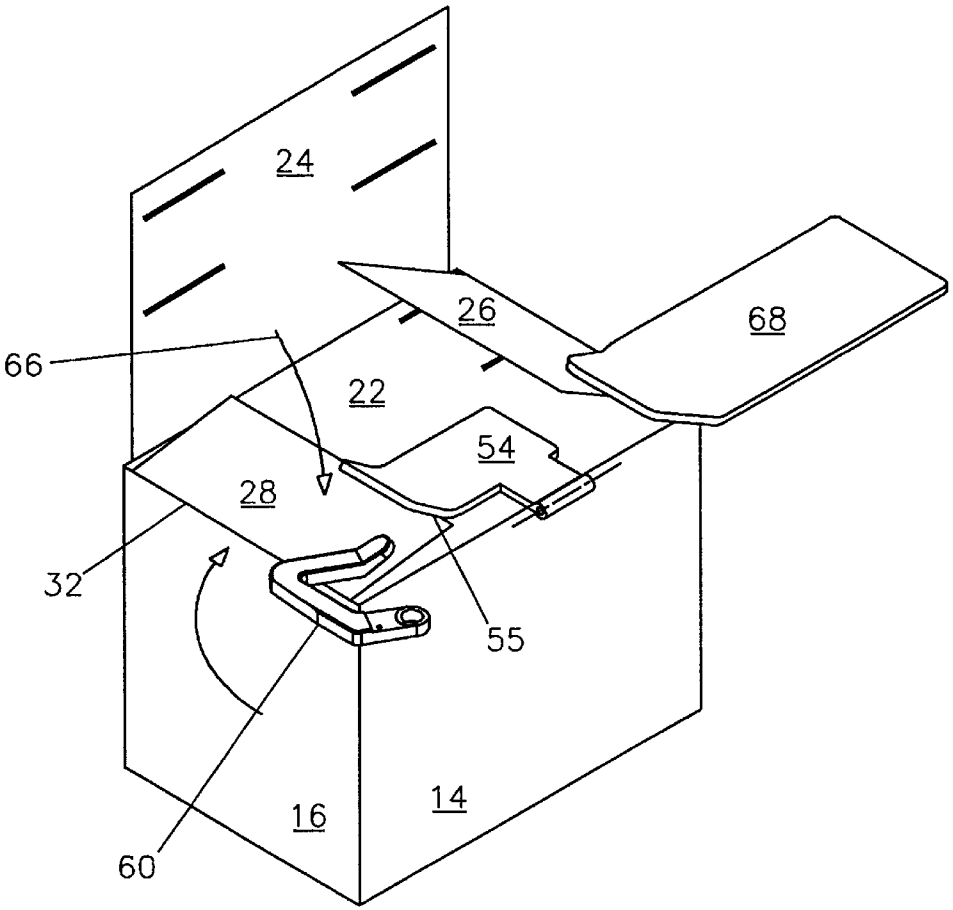

FIG. 5 is a schematic illustration of the action of the inner major flap-folding shoe holding down the trailing minor flap.

Figure 6:
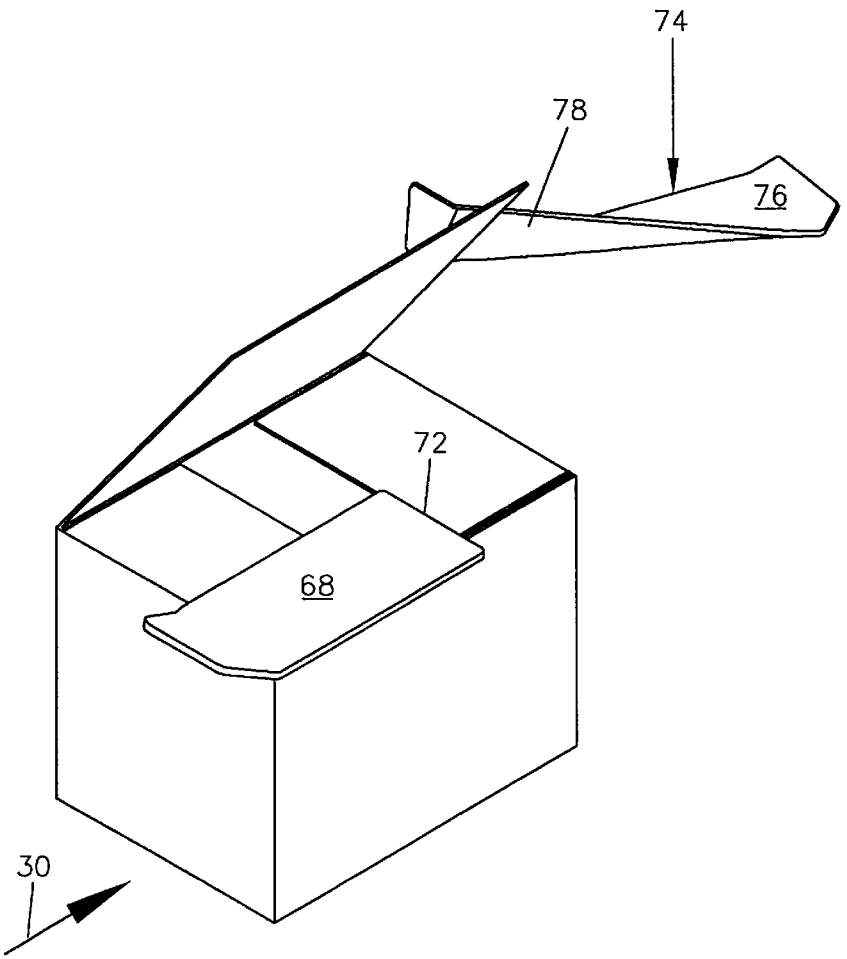

FIG. 6 is a schematic illustration of the action of the outer major flap-folding plough folding down the outer major flap while the minor flaps and inner major flaps are held in folded position by the leading minor flap folding plough.

Figure 7:
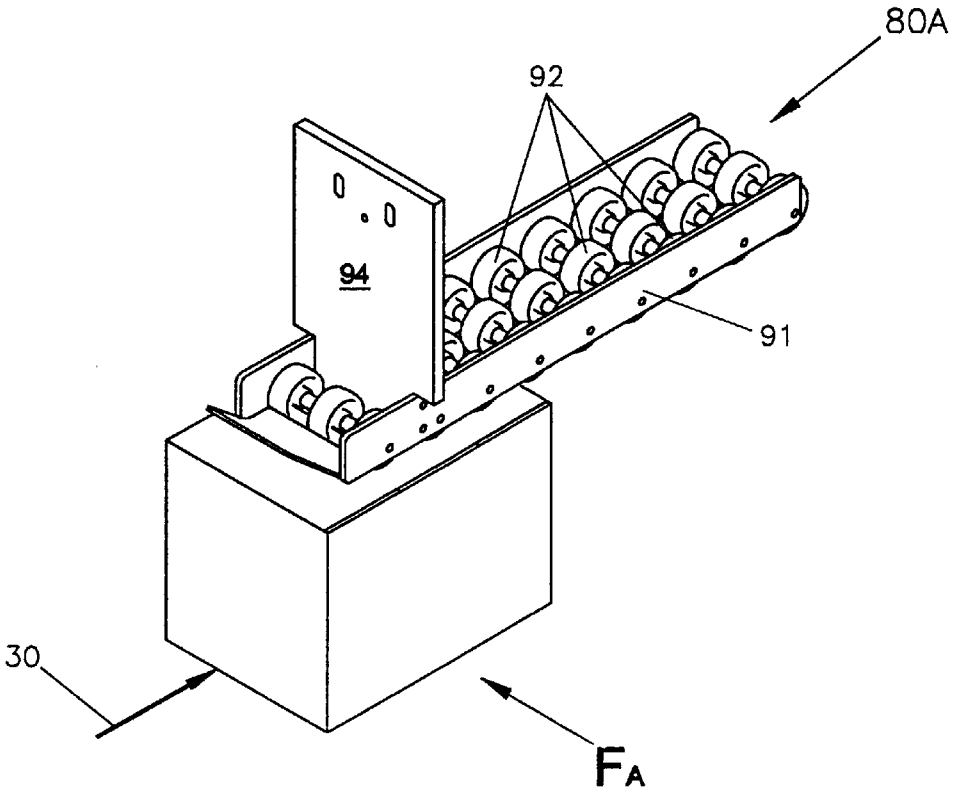

FIG. 7 illustrates and alternative compression system for compression position F.

DETAILED DESCRIPTION OF THE INVENTION

Figure 1:
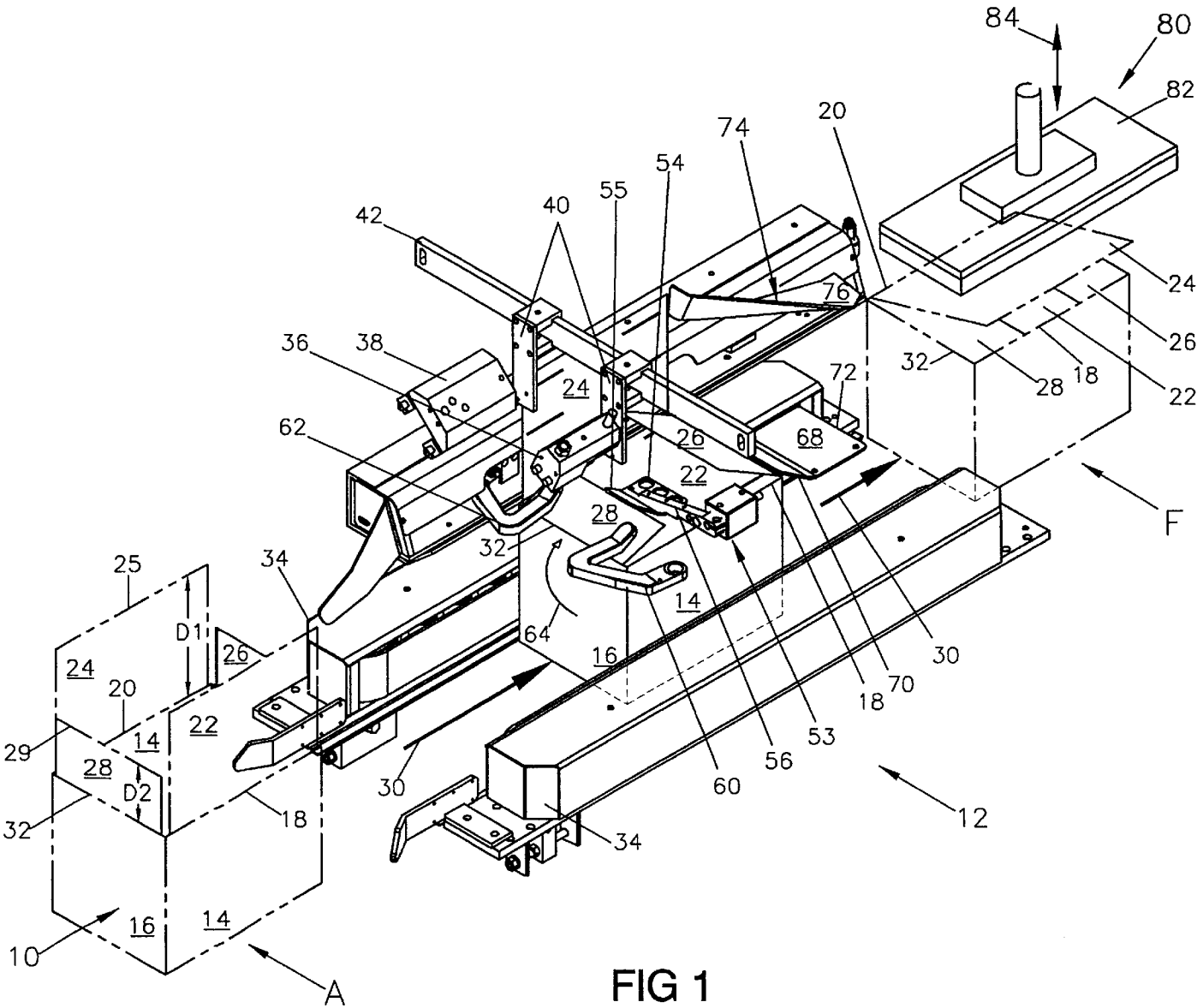
FIG. 1 is an isometric illustration of the apparatus of the present invention with parts broken away for clarity of illustration.

The structure of the machine has been shown in FIG. 1 with a box or carton 10 in position to be introduced to the folding and closing equipment 12. The box 10 illustrated is a full overlap flap box having a pair of opposed sidewalls 14 and a pair of opposed end walls 16. Foldable connected one to each of the sidewalls by fold lines 18 and 20 respectively are an inner major flap 22 and outer major flap 24. Each of the major flaps 22 and 24 have lengths substantially equal to the length or their respective side 14 (i.e. of the fold line 18 (or 20)) and a width $D_1$ measured from the fold line 18 or 20 to the free edge 25 of the respective flap 22 or 24 is more than half the full width of the end wall 16. I.e. of the length of fold line 32. The width $D_1$ of each of the flaps may if desired be made sufficiently large so that the area of each of the major flaps 22 and 24 substantially corresponds with the cross section of the box 10.

A pair of minor flaps 26 and 28 one, the leading minor flap 26, leads in the direction of movement of the box 10 through the equipment 12 as indicated by the arrow 30 and the other, the trailing minor flap, trails the flap 26 in the direction of movement 30. Each minor flap 26 and 28 is foldably attached to its respective end wall 16 by a suitable fold line 32 (only one shown). It will be noted that the minor flaps 26 and 28 are significantly shorter than the length of the major flaps measured along the fold lines 18 and 20 so that in folded position overlying the inner major flap 22 a significant portion of the flap 22 is exposed therebetween. Generally each of the minor flaps will have a width $D_2$ measured from the fold line 32 to the free edge 29 that does not exceed about ¼ the length of the side wall 14 i.e. the length of the fold line 18 (or 20).

In the initial position A as shown in FIG. 1 the flaps 22, 24, 26 and 28 are positioned preferably to extend in substantially vertically in the same plane as the side or end wall to which it is attached so that the flaps project above the side and end walls 14 and 16.

The equipment 12 is provided with a pair of opposed conveyors 34 (preferably similar to those disclosed in the above-referred-to U.S. Pat. No. 5,440,852 issued to Lam, the teaching of which are incorporated herein by reference) that engage opposed side walls 14 and move the carton 10 in straight line path as represented by the arrow(s) 30 through the machine 12.

In the first operation adhesive is applied to the outer face of the inner major flap 22 and to the inside face of the outer major flap 24 in a pattern as will be described below by the adhesive applicators 36 and 38 respectively which are supported by their respective support arm 40 from the cross bar 42. The flaps 22 and 24 are held in their vertical orientation by suitable guides 44 and 46 respectively (omitted from FIG. 1) each of which is formed by a pair of guide plates 48 and 50 which define a guiding passage substantially parallel to the direction 30 therebetween (See FIG. 2). The plates 48 flare away from each other at the entrance end of the passages 52 as indicated at 47 to facilitate entry of the flaps 22 and 24 therebetween.

In the first folding operation the inside major flap 22 is folded by an inner major flap folder 53 which includes a shoe 54 mounted on arm 56 and moveable generally by pivoting on an axis substantially parallel to the direction 30 as represented by the arrow 58 in FIG. 2 to contact the flap 22 and fold it over on fold line 18 as will be described below. The leading end of the shoe 54 is flared upward and rearward relative to the direction of travel 30 as indicated at 55 to facilitate entrance of the flap 28 therebeneath as will be described below.

Figure 2:
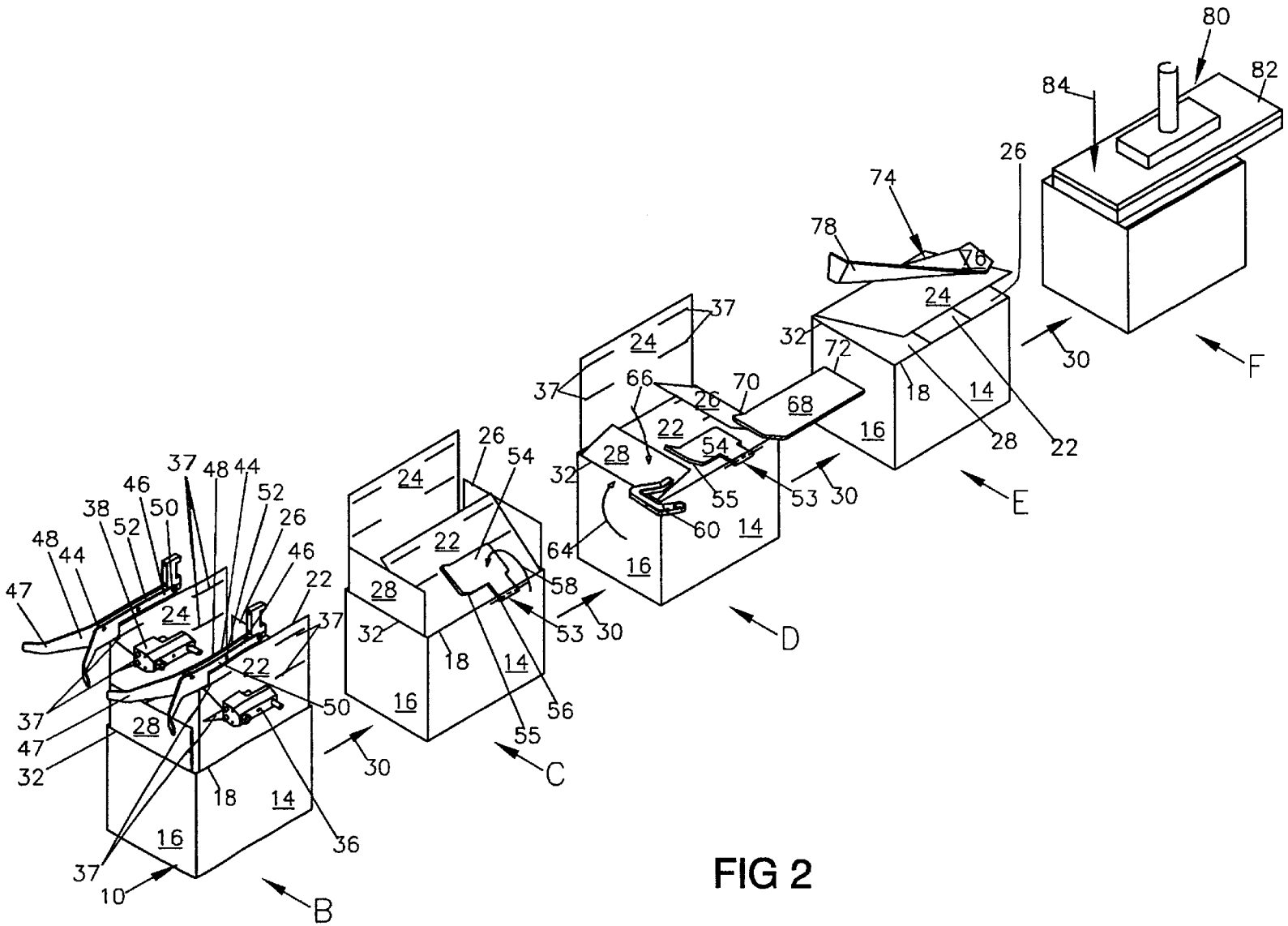
FIG. 2 is a schematic illustration of the important steps of the present invention in the sequence applied to close the flaps.

When the flap 22 has been folded by shoe 54 the box 10 has reached a position (position C in FIGS. 1 and 2) wherein the two hook like folders (snap folders) 60 and 62 on opposite sides of the path represented by arrow 30 (only one need be used, but the use of two is preferred) are positioned and activated to pivot as indicated by the arrow 64 (for hook 60) around substantially vertical axes and fold the trailing or rear minor flap 28 on its fold line 32 over the flap 22 a indicated by the arrow 66 in FIG. 2. If desired the hook folder may be replaced with a conventional folder 60A formed by an arm 61 that is swung in from behind the box 10 a velocity higher than the velocity of the box to fold the flap 28 into folded position (see FIG. 5).

The box 10 is continuously being moved along the path 30 by the conveyors 34 and is moved under a fixed plough 68 which has an upwardly and rearwardly sloping entrance end as indicated at 70 (see FIG. 2) to fold the flap 26 on its fold line 32 over the leading end of the inner major flap 22.

At the same time as the flap 26 is being folded by the plough 68 the trailing minor flap 28 is directed under the shoe 54 by the sloped end 55 of the shoe 54

As the box (trailing end wall 16) passes the forward toward the leaving or leading end 72 of the plough 68 i.e. while the flaps 26, 28 and 22 are being held in folded position by the plough 68 the outer major flap 24 is acted upon by an outer major flap folder 74 that includes a second fixed plough 76 or ski that commences to fold the flap 24 over the flaps 26 and 28 so that the outer major flap 24 engages the adjacent ends of the flaps 26 and 28 to hold them (and flap 22) in folded position with the complete folding of the flap 24 being completed when the flap 24 moves to the right of the end 72 of the plough 68. This the flap 24 is folded on fold line 20 into overlying relation with the flaps 26 and 28 so that the glue or adhesive 37 applied to the inner surface of the flap 24 adheres to the flaps 26 and 28 and holds the flaps 26, 28, 22 and 24.

The shoe 54 first holds the flaps 22 and 28 in folded relation and then the plough 68 folds the flap 26 over the flap 22 and as the box 10 proceeds it traps the flap 28 therebeneath so that the once the flaps 26, 28 and 22 have been folded they are held in folded position by the shoe 54, the plough 68 and by the outer major flap 24 overlying at least the end edges of the flaps 26 and 28 adjacent to the fold line 20. Thus the flaps 22, 26 and 28 once folded are never free to return to an unfolded position.

The conveyors 34 deposit the closed carton 10 in the F position wherein a compression system 80 compresses the carton 10 vertically. In the illustrated arrangement the compression system 80 comprises a pressure plate 82 that is moved vertically as indicated by the arrow 84 to apply pressure to the box 10 moving the adhesive and adjacent panels of the flaps into intimate contact to better ensure the bonding of the closure.

The arrangement illustrated in FIG. 1 shows the carton or box 10 stationary in position F, but if desired the compression unit may replace with a compression unit such as that illustrated at 80A (see FIG. 7). In this arrangement a frame 91 mounts a plurality of parallel rows of rollers 92 and the box is made to travel under the rollers 92 which are set at a height as schematically represented by the mounting flange 94 which is used to fix the frame 90 (to the frame of the machine) with the rollers 92 at the desired height.

Figure 3:
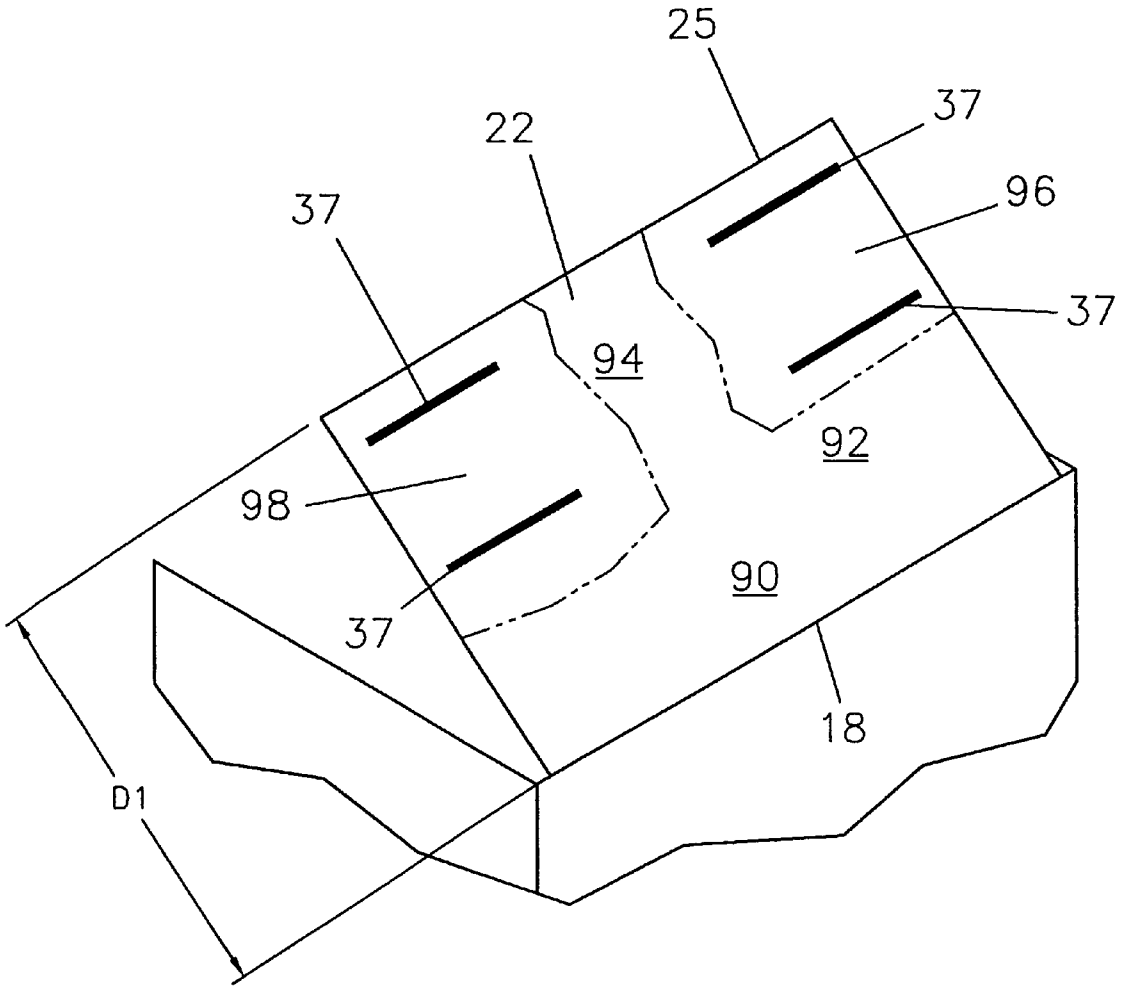
FIG. 3 is a plan view of the flap 22 showing the adhesive pattern.

With reference to FIG. 2 the method of the present invention will now be described. In the adhesive application stage position B in FIG. 2 the major flaps 22 and 24 are guided or held in position by the guides 44 and 46 respectively with the top end of the flaps 22 and 24 each received in and passing along its respective passage 48 while the applicators 36 and 38 are in their positions to dispense adhesive in stripes 37 in a specific pattern as shown in FIG. 3. The pattern leaves an area 90 free of adhesive. The adhesive free area 90 is formed by a longitudinal portion 92 extending the length of the flap 22 between the edge of the flap 22 formed by the fold line 18 and a line spaced therefrom by a distance of between about ⅓ and ⅔ the width $D_1$, preferably at least about 40% and less than 60% the width $D_1$. In the most preferred embodiment a central adhesive free portion 94 is positioned symmetrically along the longitudinal centerline of the flap 22 from the portion 90 and extends to the free edge 25 of the flap 22. The length of the portion 94 measured parallel to the free edge 25 is preferably correlated to the width $D_2$ of the flaps 26 and 28 so that the adhesive only contacts the flaps 26 and 28 when the box 10 is closed. Thus the adhesive is limited to the rectangular areas 96 and 98 outlined by dot dash lines and position one in each outside corner of the flap 22.

The adhesive free area 90 is correlated with the size of the shoe 54 and its movement in contact with the outer face of the flap 22 to ensure the shoe only contacts the flap 22 in the adhesive free area 90.

The adhesive stripes 37 are preferably applied to the inner surface of outer major flap 24 in essentially the same pattern as the adhesive is applied to the flap 22 as then the same control may be used for both applicators 36 and 38. It will be apparent that the inside of the flap 24 is not contacted by a folder thus the adhesive pattern on the inside of the flap 24 need not leave the same adhesive free space as is provided on the outside of flap 22. It is preferred that the adhesive only be applied on the flap 24 in areas directly overlying the flaps 26 and 28.

With the adhesive 37 applied the box moves into position C where the shoe 54 is moved as indicated by the arrow 58 to contact the flap 22 in the adhesive free area 90 and slides along the surface of the flap 22 as it folds flap 22 on fold line 18 into a position substantially perpendicular to the side wall 14. When the flap 22 reaches this position perpendicular to the wall 14 the hook 60 (and 62 if provided) or folder 60A (FIG. 4) is actuated and the hook 60 moves as indicated by arrow 64 to fold the flap 28 on its fold line 32 as indicated by the arrow 66 into a position perpendicular to the wall 16 and overlying the flap 22 essentially as shown in position D.

As the box 10 continues to advance in the direction 30 the leading flared portion 55 of the shoe 54 directs the flap 28 therebeneath to hold the flap 28 in folded position (see FIG. 5). As this occurs the leading minor flap 26 is contacted by the leading end 70 of the plough 68 which by continued relative movement of the box 10 and plough 68 folds the flap 26 into a position perpendicular to the wall 16 and overlying the flap 22. In these positions the adhesive stripes 37 on the outside surface of the flap 22 are brought into contact with the flaps 26 and 28 to secure the flaps 26 and 28 to the inside major flap 22. As above described the plough 68 holds the flaps 26 and 28 against the inner major flap 22 until the folding of the flap 24 has advanced sufficiently to trap the flaps 26 and 28 and thus hold the flaps 26, 28 and 22 folded. Obviously the adhesive on the flap 22 contacting the flaps 26 and 28 help to hold the flaps 26, 28 and 22 in their folded positions.

As the box 10 clears the edge leading end 72 of the plough 68 the ski or plough 74 completes the folding of the outside major flap 24 over top of the box 10 and brings the adhesive stripes 37 on the inside surface of the flap 24 into contact with the flaps 26 and 28 to secure the outer flap 24 to the flaps 26 and 28, i.e. the flaps 26 and 28 are sandwiched between and secured to the major flaps 22 and 24 to complete the closing of the box 10 as illustrated in position E.

The closed box 10 then moves into the compression station or position F where the compressor 80 or compressor 80A compress the flaps 22, 24, 26 and 28 together and may if desired slightly compress the box 10.

It will be apparent that folding plough, particularly the plough 74 could be replaced by other suitable folders, such as a moveable shoe similar to that shown at 54, provided the timing and positioning of such a shoe results in the leading and trailing minor flaps and the inner major flap are held in position untill the outer major flap is partially folded and is in a position to trap and hold the flaps so folded when released by the plough by plough 68 and folding of the outer flap 24 is completed when the carton 10 has passed (clears) the trailing end 72 of the plough 68.

Having described the invention, modifications will be evident to those skilled in the art without departing from the scope of the invention as defined in the appended claims.

I claim:

1. A method for closing a carton having mutually perpendicular side and end walls and an inner major overlap flap and an opposed outer major overlap flap each having dimensions more than half the width dimensions of said carton and each foldably connected along one side via a longitudinal fold line to it adjacent of said side walls and a pair of opposed minor flaps each foldably connected along one side via a transverse fold line to its adjacent of said end walls, each said minor flap having a length corresponding to a that of said end wall of said carton to which it is connected and a width extending from said transverse fold line to a free edge of said minor flap significantly shorter than length of said longitudinal fold line, comprising positioning said carton with said major and minor flaps in planes substantially parallel to said end or side wall to which it is connected, moving said carton with said flaps so positioned along a path in a direction parallel to said planes in which said major flaps are positioned, retaining said major flaps in their respective said plane, applying adhesive to an inner surface of said outer major flap and to an outer surface of said inner major flap while said flaps are so retained, folding said inner major flap into a folded position substantially perpendicular to said side wall to which it is connected, folding a trailing one of said minor flaps trailing in said direction of movement into a folded position overlying said inner major flap as said carton is moved long said path, holding said inner major flap and said trailing minor flap in said folded positions and folding a leading of said minor flaps leading in said direction of movement over said inner major flap as said carton is moved along said path, holding said trailing and said leading minor flaps and said inner major flap in folded positions and folding said outer major flap into a folded position overlying said minor flaps and said inner major flap.

2. A method as defined in claim 1 wherein said holding said trailing and said leading minor flaps and said inner major flap in folded positions and folding said outer major flap into a folded position overlying said minor flaps and said inner major flap comprises trapping said minor flaps beneath said outer major flap while said flaps are held in folded position and by a folder used to fold said leading minor flap and folder used to fold said leading minor flap releasing said flaps after said trapping and before folding of said outer major flap is completed.

3. A method as defined in claim 2 wherein said applying adhesive to an inner surface of said outer major flap and to an outer surface of said inner major flap while said flaps are so retained and said folding said inner major flap into a folded position substantially perpendicular to said side wall to which it is connected are coordinated so that said folding said inner major flap into a folded position does not disrupt said adhesive applied to said inner major flap.

4. A method as defined in claim 3 wherein said folding said inner major flap into a folded position does not disrupt said adhesive applied to said inner major flap comprises applying said adhesive to said inner flap in a pattern leaving a longitudinal portion of said inner major flap extending parallel to and adjacent to said fold line connecting said inner major panel to it adjacent side wall and along the full length of said inner major flap substantially free of adhesive to provide an adhesive area free area on said outer surface of said inner major flap wherein a folding element used to apply pressure to said inner major flap for said folding of said inner major flap into said position substantially perpendicular to said side wall may contact said outer surface of said inner major flap only in said adhesive free area.

5. A method as defined in claim 4 wherein said longitudinal portion extends over at least 40% of said outer surface.

6. A method as defined in claim 5 wherein said pattern also leaves a central portion between adhesive applied areas extending said adhesive free area from said longitudinal portion between said adhesive applied areas toward a free edge of said inner major flap remote from said fold line connecting said inner major flap to its said side wall.

7. A method as defined in claim 4 wherein said pattern also leaves a central portion between adhesive applied areas extending said adhesive free area from said longitudinal portion between said adhesive applied areas toward a free edge of said inner major flap remote from said fold line connecting said inner major flap to its said side wall.

8. A method as defined in claim 1 wherein said applying adhesive to an inner surface of said outer major flap and to an outer surface of said inner major flap while said flaps are so retained and said folding said inner major flap into a folded position substantially perpendicular to said side wall to which it is connected are coordinated so that said folding said inner major flap into a folded position does not disrupt said adhesive applied to said inner major flap.

9. A method as defined in claim 8 wherein said folding said inner major flap into a folded position does not disrupt said adhesive applied to said inner major flap comprises applying said adhesive to said inner flap in a pattern leaving a longitudinal portion of said inner major flap extending parallel to and adjacent to said fold line connecting said inner major panel to it adjacent side wall and along the full length of said inner major flap substantially free of adhesive to provide an adhesive area free area on said outer surface of said inner major flap wherein a folding element used to apply pressure to said inner major flap for said folding of said inner major flap into said position substantially perpendicular to said side wall may contact said outer surface of said inner major flap only in said adhesive free area.

10. A method as defined in claim 9 wherein said longitudinal portion extends over at least 40% of said outer surface.

11. A method as defined in claim 10 wherein said pattern also leaves a central portion between adhesive applied areas extending said adhesive free area from said longitudinal portion between said adhesive applied areas toward a free edge of said inner major flap remote from said fold line connecting said inner major flap to its said side wall.

12. A method as defined in claim 9 wherein said pattern also leaves a central portion between adhesive applied areas extending said adhesive free area from said longitudinal portion between said adhesive applied areas toward a free edge of said inner major flap remote from said fold line connecting said inner major flap to its said side wall.

13. A method as defined in claim 1 wherein further comprising pressing of said outer flap in a pressing station when folding of said outer flap has been completed.

14. An apparatus for closing a carton having mutually perpendicular side and end walls and an inner major overlap flap and an opposed outer major overlap flap each having dimensions substantially more than half the width dimensions of said carton and each foldably connected along one side via a longitudinal fold line to its adjacent of said side walls and a pair of opposed minor flaps each foldably connected along one side via a transverse fold line to its adjacent of said end walls, each said minor flap having a length corresponding to a that of said end wall of said carton to which said minor flap is connected and a width extending from said transverse fold line to a free edge of said minor flap significantly shorter than length of said longitudinal fold line, comprising means for moving said carton from a starting position with said major and minor flaps in planes substantially parallel to said end or side wall to which said major or minor flap is connected along a path in a direction parallel to said planes in which said major flaps are positioned, means for retaining said major flaps in their respective said plane, adhesive applicators for applying adhesive to an inner surface of said outer major flap and to an outer surface of said inner major flap while said flaps are so retained, an inner major flap folder having a shoe moveable relative to said path to fold said inner major flap into a folded position substantially perpendicular to said side wall to which said inner major flap is connected, a folding mechanism moveable relative to said path to fold a trailing one of said minor flaps trailing in said direction of movement into a folded position overlying said inner major flap in its folded position as said means to move moves said carton along said path, said shoe portion having a guiding portion sloping outward relative to said carton and rearward relative to said direction of travel, said guiding portion extending rearward relative to said shoe portion relative to said direction of travel and being in position to plough said trailing minor flap toward said inner major flap when said inner major flap has been folded and advanced thereunder, a folding plough positioned to contact a leading one of said minor flaps leading in said direction of movement and fold said leading minor flap into its folded position over said inner major flap as said carton is moved along said path, said shoe portion having a length parallel to said path and positioned to extend along said path a distance to hold said inner major flap and said trailing minor flap in their said folded positions until said folding plough folds said leading minor flap into its said folded position, a folder positioned along said path to fold said outer major flap into its folded position overlying said minor flaps and said inner major flap, said shoe portion and said folding plough having a length extending in said direction of movement and said folder being positioned so as to hold said trailing minor flap and said inner major flap in their folded positions until said carton is positioned under said folding plough and said folding plough holds said trailing and said leading minor flaps and said inner major flap in their folded positions at least until said folder moves said outer major flap into position to hold said trailing and said leading minor flaps and said inner major flap in their folded positions.

15. An apparatus as defined in claim 14 wherein said folder comprises a second folding plough mounted in fixed position relative to said path.

16. An apparatus as defined in claim 15 further comprising a pressing station leading said second plough in said direction of movement, said pressing station including means to apply pressure on said outer major flap to compress said carton.

17. An apparatus as defined in claim 15 wherein said adhesive applicator is constructed to apply adhesive to said outer surface in a pattern that leaves an area substantially free of adhesive, said area having a longitudinal portion on said inner major flap extending parallel to and adjacent to said fold line connecting said inner major panel to its adjacent side wall and along the full length of said inner major flap substantially free of adhesive to provide said adhesive area free area on said outer surface of said inner major flap and wherein folding arm for said folding of said inner major flap into its said folded position substantially perpendicular to said side wall is positioned during folding of said inner major flap to contact said outer surface of said inner major flap only in said adhesive free area.

18. An apparatus as defined in claim 17 wherein said adhesive applicator is constructed so that said pattern also leaves a central portion between adhesive applied areas extending said adhesive free area from said longitudinal portion between said adhesive applied areas toward a free edge of said inner major flap remote from said fold line connecting said inner major flap to its said side wall.

19. An apparatus as defined in claim 14 wherein said adhesive applicator is constructed to apply adhesive to said outer surface so in a pattern that leaves an area substantially free of adhesive, said area having a longitudinal portion on said inner major flap extending parallel to and adjacent to said fold line connecting said inner major panel to its adjacent side wall and along the full length of said inner major flap substantially free of adhesive to provide said adhesive area free area on said outer surface of said inner major flap and wherein folding arm for said folding of said inner major flap into its said folded position substantially perpendicular to said side wall is positioned during folding of said inner major flap to contact said outer surface of said inner major flap only in said adhesive free area.

20. An apparatus as defined in claim 19 wherein said adhesive applicator is constructed so that said pattern also leaves a central adhesive free portion of said adhesive free area between adhesive applied areas extending said adhesive free area from said longitudinal portion between said adhesive applied areas toward a free edge of said inner major flap remote from said fold line connecting said inner major flap to its said side wall.

* * * * *